US010981757B2

(12) United States Patent
Stinis

(10) Patent No.: US 10,981,757 B2
(45) Date of Patent: Apr. 20, 2021

(54) DEVICE FOR DETECTING A POSITION OF A HOISTING FRAME AND USE THEREOF TO CONTROL A HOISTING FRAME SUSPENDED FROM A CRANE

(71) Applicant: STINIS BEHEER B.V., Krimpen aan de Lek (NL)

(72) Inventor: Cornelis Stinis, Krimpen aan de Lek (NL)

(73) Assignee: STINIS BEHEER B.V., Krimpen aan de Lek (NL)

( * ) Notice: Subject to any disclaimer, the term of this patent is extended or adjusted under 35 U.S.C. 154(b) by 0 days.

(21) Appl. No.: 16/073,075

(22) PCT Filed: Feb. 1, 2017

(86) PCT No.: PCT/NL2017/050066

§ 371 (c)(1),
(2) Date: Jul. 26, 2018

(87) PCT Pub. No.: WO2017/135819

PCT Pub. Date: Aug. 10, 2017

(65) Prior Publication Data

US 2019/0031477 A1 Jan. 31, 2019

(30) Foreign Application Priority Data

Feb. 1, 2016 (NL) ..... 2016192

(51) Int. Cl.
*B66C 13/46* (2006.01)
*B66C 1/10* (2006.01)
*B66C 13/08* (2006.01)

(52) U.S. Cl.
CPC ..... *B66C 13/46* (2013.01); *B66C 1/101* (2013.01); *B66C 13/085* (2013.01)

(58) Field of Classification Search
CPC ..... B66C 13/46; B66C 13/085; B66C 1/101
See application file for complete search history.

(56) References Cited

U.S. PATENT DOCUMENTS 6,145,903 A * 11/2000 Stinis ..... B66C 1/102 294/81.1
6,542,580 B1 * 4/2003 Carver ..... G01V 5/0008 378/57

(Continued)

FOREIGN PATENT DOCUMENTS

CN 1121897 A 5/1996
CN 101489906 A 7/2009

(Continued)

OTHER PUBLICATIONS

PCT International Search Report and Written Opinion from PCT/NL2017/050066 dated Jun. 8, 2017, 12 pages.

(Continued)

*Primary Examiner* — Stephen A Vu
(74) *Attorney, Agent, or Firm* — Kacvinsky Daisak Bluni PLLC

(57) ABSTRACT

A device for detecting a position of a hoisting frame includes one or more image sensors connected movably to the hoisting frame and protruding outside a periphery thereof in a position of use. The image sensors can be movable between the position of use and a protected position lying within the periphery of the hoisting frame. The device can be provided with means for biasing the image sensor(s) from the protected position to the position of use. A method for controlling a hoisting frame suspended from a crane includes moving the hoisting frame to a first position under the control of an automatic control system, holding the hoisting frame stationary in the first position, making one or more image recordings of the area around the hoisting frame in the first position and moving the hoisting frame to a (Continued)

second position on the basis of the image recording(s), wherein the image recording(s) is/are made by one or more image sensors connected to the hoisting frame.

20 Claims, 5 Drawing Sheets

(56) References Cited

U.S. PATENT DOCUMENTS

| | | | | |
|---|---|---|---|---|
| 7,178,846 | B2 * | 2/2007 | Niskanen | B66C 1/663 294/81.2 |
| 7,686,363 | B2 * | 3/2010 | Karlsson | B66C 1/102 294/81.1 |
| 8,567,834 | B2 * | 10/2013 | Bergstrom | B66C 1/663 294/81.21 |
| 2004/0100111 | A1 * | 5/2004 | Stinis | B66C 1/663 294/81.21 |

FOREIGN PATENT DOCUMENTS

| | | | | |
|---|---|---|---|---|
| DE | 102013011718 | A1 | 1/2015 | |
| EP | 0668236 | A1 | 8/1995 | |
| JP | 2007031102 | A * | 2/2007 | B66C 13/48 |
| KR | 20040027805 | A | 4/2004 | |
| KR | 200400278085 | A | 4/2004 | |
| KR | 101058594 | B1 | 8/2011 | |
| WO | 2003016194 | A1 | 2/2003 | |

OTHER PUBLICATIONS

PCT International Preliminary Report on Patentability from PCT/NL2017/050066 dated Aug. 16, 2017, 9 pages.

* cited by examiner

DEVICE FOR DETECTING A POSITION OF A HOISTING FRAME AND USE THEREOF TO CONTROL A HOISTING FRAME SUSPENDED FROM A CRANE

This is a national stage application filed under 35 U.S.C. 371 of pending international application PCT/NL2017/050066, filed Feb. 1, 2017, which claims priority to Netherlands national patent application NL 2016192, filed Feb. 1, 2016, the entirety of which applications are incorporated by reference herein.

The invention relates to a device for detecting a position of a hoisting frame as described in the preamble of claim 1. Such a detecting device is known, for instance from EP 0 668 236 A1.

Hoisting frames are generally suspended from a crane by means of hoisting elements such as hoisting cables or chains and are used to pick up a load in quick and reliable manner A known example of a hoisting frame is a spreader, with which containers and other loads can be picked up. Spreaders are usually used at container terminals under transfer cranes, but also in combination with transport vehicles.

Container terminals are highly automated at the present time. Cranes in which a crane driver is no longer present are thus already being used on the land side of modern terminals for storing supplied containers. These cranes are controlled by programs on the basis of detection by different sensors. Wide use is already also being made of automatically controlled vehicles (Automated Guide Vehicles or AGVs) for transport of containers between different locations at a terminal, for instance between a quayside crane on the waterside which unloads containers from a ship (ship-to-shore or STS crane) and a storage crane on land side (yard crane).

STS cranes are still often controlled by human crane drivers. This is done because the unloading or loading of containers respectively from or out of or onto or into a vessel often requires complex movements which must moreover be carried out relatively quickly. Moored vessels often do not lie perfectly still along the quay, and weather and ambient influences can have a significant effect on the movement of a hoisting frame and the load (container) attached thereto. Control is therefore not easily automated. The time for which a ship is stationary at the quay is moreover costly, so that high unloading and loading speeds are necessary. This is an additional complicating factor. Finally, errors can have serious consequences, on the one hand because containers often contain expensive cargo and on the other because disruptions result in an unnecessarily long stay of the vessel in port.

Particularly the introduction of a hoisting frame into a cell in a hold of a vessel is a movement which up until now could not be automated. Even in the case of the newest generation of container terminals, in which automated operation of the STS cranes is also anticipated, provision is made that human intervention will be necessary for lowering a hoisting frame into a cell. There are various reasons for this. In the first place the dimensions of a cell are precisely adapted to the outer dimensions of a container, and so also substantially correspond to the outer dimensions of a spreader, so that there is hardly any space to manoeuvre. In addition a spreader, whether or not it has a container attached thereto, can make movements relative to the cell which are difficult to control. As stated, the vessel can move, while in addition the spreader can swing in the direction of the quay as a result of the rapid hoisting and lowering movements and the movements of the crane and the trolley. A spreader with a container thereon can also make a twisting movement about a vertical axis, while it can also be set into motion by weather influences, in particular a hard wind.

Provision is therefore made that in an automated loading or offloading process the spreader is moved to the entrance of a cell under the influence of a control system, and that lowering is then stopped. From a position just above the cell the spreader is then lowered under human control into the cell. From the moment that the spreader is situated in the cell the control can then be taken over again by the automated system. The human control takes place from a central control area where a single operator can monitor and control a plurality of cranes. Use is made here of cameras which are mounted on the crane and oriented downward toward the vessel.

The described system has a number of drawbacks however. The placing of the cameras at a distance from the spreader—in order to prevent damage—thus has the result that the cameras are poorly accessible, for instance for maintenance or replacement. In addition, quite a few cameras are necessary to provide the operator with a sufficiently clear indication of the position of the spreader—and container possibly attached thereto—relative to the cell. The cameras often also do not provide an accurate indication of the situation, whereby there is still the risk of a spreader or container being lowered in incorrect position into the cell and becoming jammed therein, possibly with damage and delays as a result.

The above stated document EP 0 668 236 A1 describes a spreader 5 with laser distance sensors accommodated in the housings of the twist-locks at the corner points of the spreader. Each laser distance sensor has a downward oriented mirror in a chamfered conical head which is slidable in the housing of the twist-lock. The head and the distance sensor connected thereto are urged outward by a spring. The laser distance sensors generate data which are used for the automatic control of the movement of the spreader. Because the laser distance sensors are received with their slidable head in the housings of the twist-locks, the sliding mechanism and the spring are relatively compact and not particularly robust. A laser distance sensor moreover has only a limited field of vision from a corner point of the spreader, so that for optimal control a laser distance sensor has to be arranged at each corner. The device hereby becomes complex and costly.

The invention therefore has for its object to provide a device for detecting a position of a hoisting frame wherein the said drawbacks do not occur, or at least do so to lesser extent. According to the invention this is achieved with a detecting device of the above described type in that the at least one sensor is an image sensor and at least one image sensor is arranged on each of the short sides at a position lying between the ends thereof.

By making use of one or more image sensors directly connected to the hoisting frame a reliable image of the position of the hoisting frame is obtained quickly and easily. A good image of the area around the hoisting frame is obtained by having the image sensor(s) protrude outside the periphery of the hoisting frame. Because of the movable suspension of the image sensor(s) the likelihood of damage thereto is minimal, since in the protected position the image sensor is safeguarded by the hoisting frame itself from damage through contact with the surrounding area.

Possible variations in the position of the hoisting frame (or the load attached thereto) relative to the cell are most clearly visible along the short side of the hoisting frame, whereby a rapid feedback and an effective control are possible. By arranging the image sensor not on a corner of the hoisting frame but at a central position along the short side there is space for a relatively large and robust embodiment of the construction and the moving mechanism which must protect the image sensor from damage. A relatively large area can moreover be thus covered with a single image sensor.

Each short side of the hoisting frame is preferably formed by an end beam, and the hoisting frame further comprises at least one longitudinal beam, wherein the at least one image sensor is arranged on the end beam substantially in line with the at least one longitudinal beam. Possibly required cabling for the image sensor can then be easily accommodated in the longitudinal beam.

When the hoisting frame comprises a central frame part receiving the longitudinal beam(s), movable image sensors can also be arranged on the central frame part. There is after all also sufficient space here and there is the possibility of a large field of vision.

A preferred embodiment of the detecting device is provided with means for biasing the at least one image sensor from the protected position to the position of use. This guarantees that the image sensor is in principle always in the position of use. These biasing means can be of mechanical nature and comprise for instance a spring, a bellows or a pulley.

The at least one image sensor is preferably received in a body which is shaped such that under the influence of an external load it moves to the protected position. Heavy contact with the area around the hoisting frame will thus automatically result in the image sensor being moved into a safe position. The image sensor is moreover protected from damage in that it is received in the body.

This can be achieved for instance when the body has a base part which faces toward the hoisting frame and is relatively wide and an outer end which faces away from the hoisting frame and is relatively narrow, and the at least one image sensor is arranged in or close to the narrow outer end. The shape tapering from the broad to the narrow end provides for the desired movement here, while the image sensor, because of its position at the outer end of the body, protrudes far enough outside the hoisting frame to form a good image of the surrounding area.

The body can for instance be at least partially conical. A cone shape has the same angle of inclination at every point and thereby results in the same movement irrespective of the point where the external load engages on the body. Other shapes can also be envisaged for the body, such as a pyramid shape or a curved shape. A curved shape is for instance a (partial) spherical shape or an elliptical body of revolution.

The desired mobility of the image sensor can be easily achieved when the body is mounted slidably in the hoisting frame. A sliding movement can be realized with structurally simple and robust means.

A pivotable mounting of the body can on the other hand also be envisaged, for instance a spring-mounted suspension of the body pivotable to different sides in an oversize housing. The desired mobility can in this way also be realized.

With a view to the lifespan of the detecting device the body is preferably manufactured from a material able to withstand impact loads, for instance plastic, rubber or a (light) metal.

When the hoisting frame has an upper side with means for suspension thereof from hoisting elements and an underside lying opposite the upper side, the at least one image sensor preferably has a field of vision oriented toward the underside of the hoisting frame. The image information can thus be collected which is important for moving of the hoisting frame into a cell. The field of vision of the at least one image sensor advantageously comprises a lower edge of a load attached to the hoisting frame. This lower edge is the first part of the combination of hoisting frame and load which can come into contact with obstacles in or close to the cell.

In order to simplify assessment by an operator, the at least one image sensor preferably comprises a camera or a scanner which can generate images discernible by the human eye.

The at least one image sensor can on the other hand also be configured to generate images suitable for digital processing, for instance by means of image recognition. The introduction of the hoisting frame into a cell can in this way also be ultimately automated.

The detecting device is more preferably provided with means for connecting the at least one image sensor to a control system for a crane from which the hoisting frame is suspended. These connecting means can be wireless, for instance in the form of a transmitter and receiver for WiFi, Bluetooth or other wireless communication protocol, although a wired connection can also be envisaged, for instance in the form of a glass fibre or other data line.

The invention further relates to a method for controlling a hoisting frame suspended from a crane, wherein use is made of the above discussed insights. A control method in an automated environment is for instance described in DE 10 20 13 011 718 A1. The method described here comprises the steps of moving the hoisting frame to a first position under the control of an automatic control system, holding the hoisting frame stationary in the first position, making at least one image recording of the area around the hoisting frame in the first position by means of at least one image sensor connected to the hoisting frame, and moving the hoisting frame to a second position on the basis of the at least one image recording.

The method according to the invention is distinguished herefrom in that the hoisting frame is moved to the second position under the control of an operator on the basis of the at least one image recording. Thus obtained is an optimal combination of automatic control and manual control, which in some situations is still superior.

For an optimal control of the hoisting frame it is preferred that in the first position a plurality of image recordings are made simultaneously by image sensors connected at different locations to the hoisting frame. The operator thus obtains a comprehensive indication of the position of the hoisting frame (with load possibly attached thereto) relative to the cell.

The hoisting frame is preferably moved from the second position to a third position under the control of an automatic control system. The human intervention thus remains limited to only a small part of the overall offloading or loading movement, which can otherwise be wholly automated, whereby the process can take place very quickly and accurately.

Although the method can be applied in different fields, it is particularly suitable for use in situations where the first position is located in the vicinity of an entrance to a cell in a container ship.

The invention will now be elucidated on the basis of two examples, wherein reference is made to the accompanying drawing in which corresponding components are designated with the same reference numerals, and in which.

Figure 1:
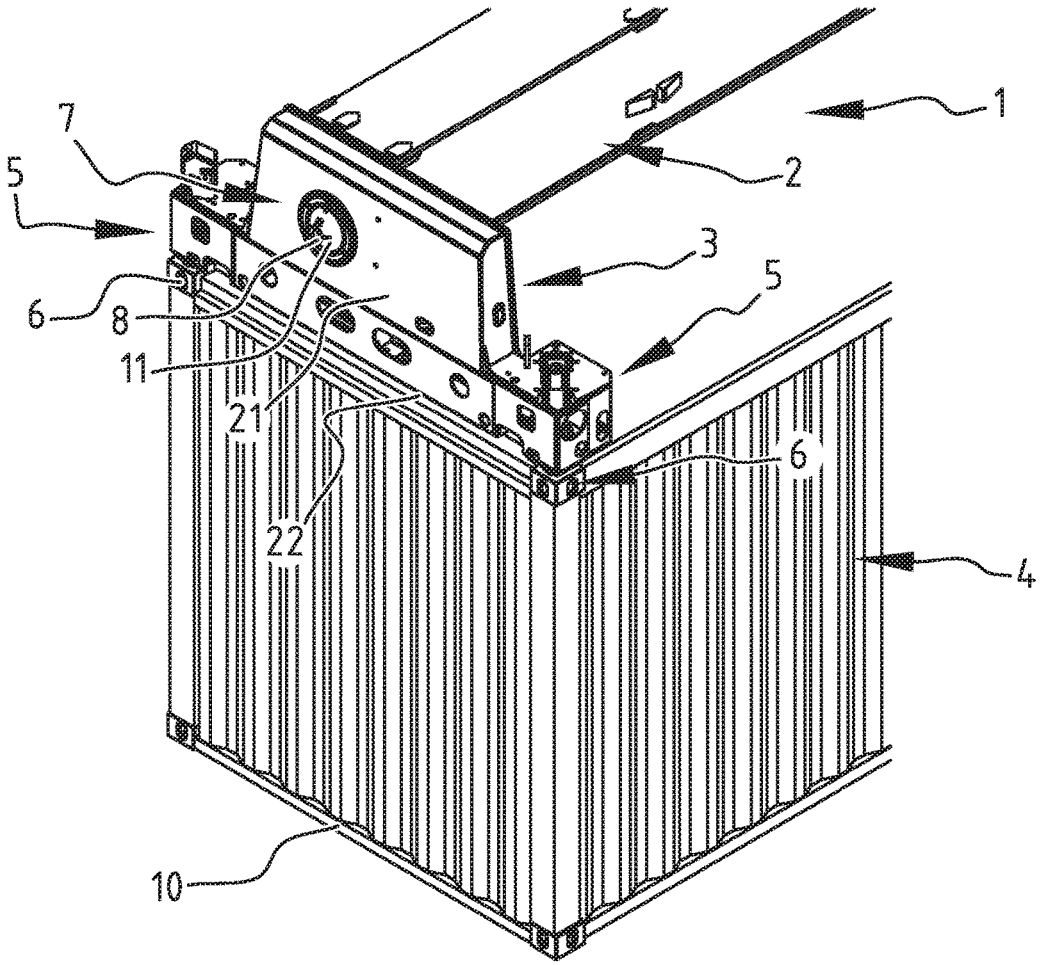
FIG. 1 is a perspective top view of a part of a hoisting frame and container attached thereto, wherein the hoisting frame is provided with a detecting device according to a first embodiment of the invention.
Figure 2:
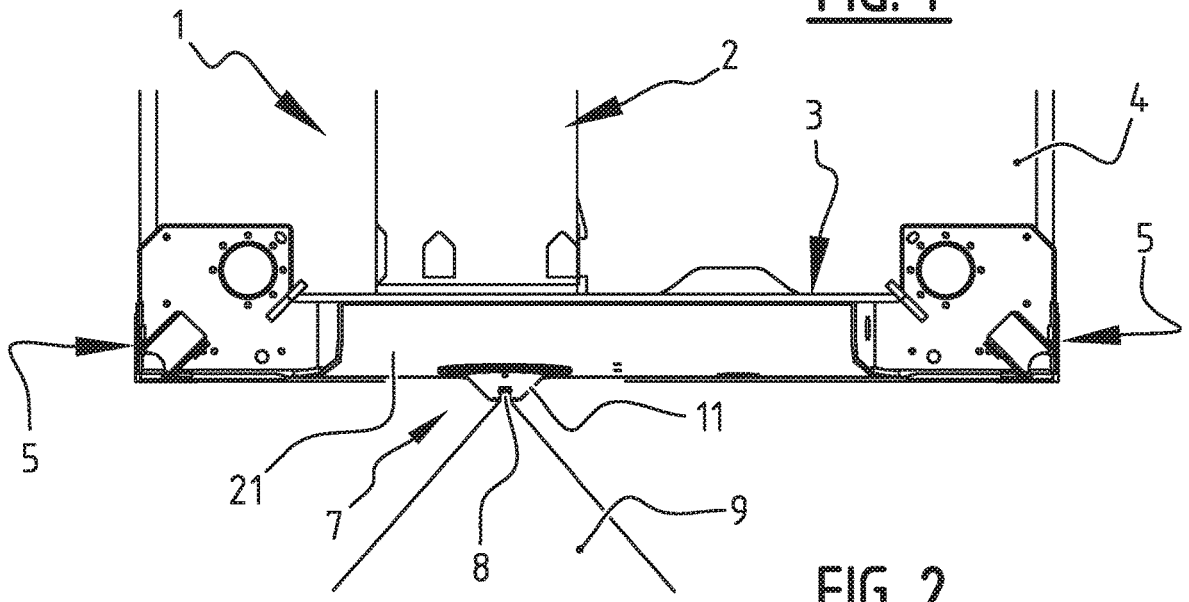
FIG. 2 is a top view of a part of the hoisting frame and the container of FIG. 1 in which the field of vision of the detecting device is represented schematically.

A hoisting frame 1 in the form of a spreader (FIG. 1) comprises two longitudinal beams 2 and two end beams 3 running in transverse direction. Longitudinal beams 2 are mounted slidably in a central frame part 23 (FIG. 10) which is provided with cable pulleys 24 around which are trained the hoisting cables with which hoisting frame 1 is suspended from a crane. Hoisting frame 1 bears a load, in the shown example a unit load or container 4. Container 4 is attached to hoisting frame 1 by means of couplings 5 at the outer ends of end beams 3 in the form of so-called twist-locks. These twist-locks are mounted in corner castings 6 of container 4.

In order to be able to monitor the movements of hoisting frame 1 and load 4 attached thereto during hoisting or lowering the hoisting frame 1 is provided with a device 7 for detecting the position of hoisting frame 1. This detecting device 7 is connected to a control system of the crane. This connection, which is not further shown here, can be effected wirelessly as well as via wiring.

Figure 3:
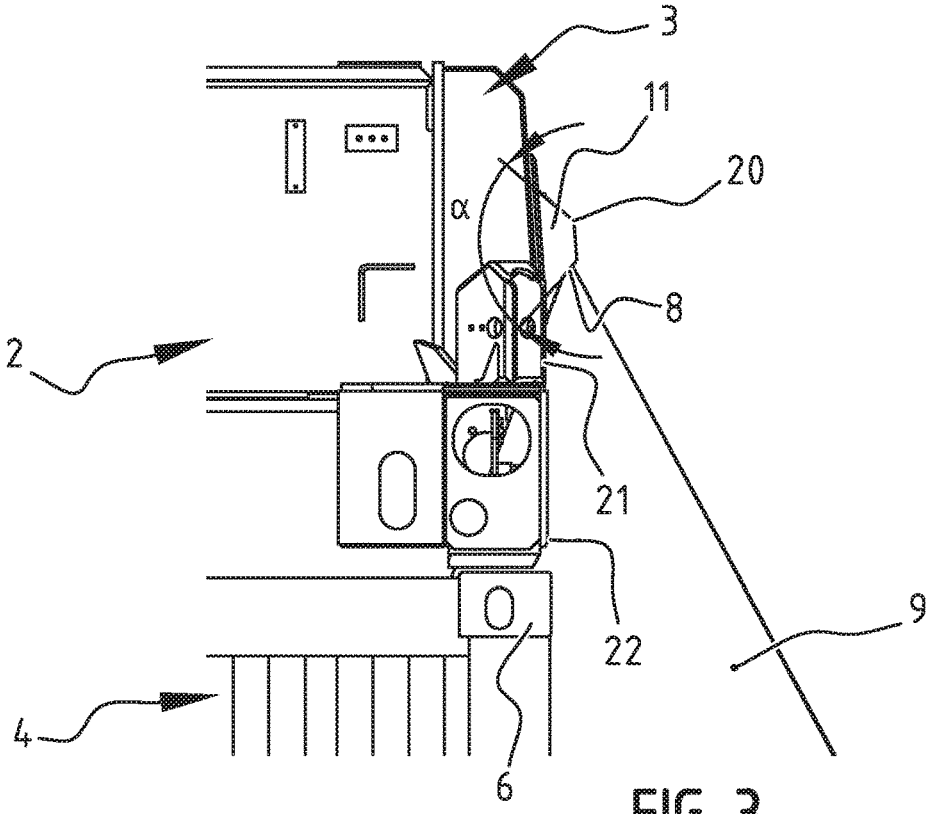
FIG. 3 is a side view of a part of the hoisting frame and the container of FIG. 1 in which the field of vision of the detecting device is represented schematically.

Detecting device 7 comprises one or more image sensors 8 which are connected movably to end beams 3 of hoisting frame 1 at a position substantially halfway between twist-locks 5 and which during use protrude outside the periphery of hoisting frame 1. Image sensor 8 is formed in the shown embodiment by a camera, although another type of image sensor, such as for instance a scanner, can also be envisaged. Camera 8 is oriented downward (FIG. 3, 5) so that a field of vision 9 of the camera includes a lower edge 10 of the container attached to hoisting frame 1. Camera 8 and thus properly detect the position of lower edge 10 relative to a cell in a vessel. Because of the central position this single camera 8 covers substantially the whole width of the container.

In order to protect camera 8 from damage through contact with objects in the vicinity of hoisting frame 1, camera 8 is movable from the shown protruding position of use to a protected position in which it lies within the periphery of hoisting frame 1. In the shown embodiment camera 8 is received for this purpose in a body 11 which is mounted slidably in hoisting frame 1. Means 12 are present which urge or "bias" body 11 with camera 8 therein back to the position of use outside the periphery of hoisting frame 1. These biasing means 12 can be of mechanical nature and can take a spring-mounted form.

Body 11 is shaped here such that, under the influence of an external load, it moves to the protected position within the periphery of hoisting frame 1. In the shown embodiment this is realized in that body 11 has a tapering form, in particular a truncated conical form. With a suitable choice of the apex angle $\alpha$ of this cone loads in vertical direction can be converted to a horizontal sliding movement of body 11 in hoisting frame 1. In the shown embodiment the apex angle $\alpha$ amounts to 90°, although other values can also be envisaged. In order to guarantee that body 11 is always urged inward upon contact with an obstacle, it is preferred to select the largest possible apex angle $\alpha$ so that the inward directed component of the load is as great as possible. Should the movement of body 11 nevertheless be blocked, this not only entails the risk of damage to camera 8 but it could in the worst case even result in hoisting frame 1 becoming jammed A large apex angle $\alpha$ moreover results in a robust construction of body 11, whereby it can properly withstand the loads which occur.

Figure 4:
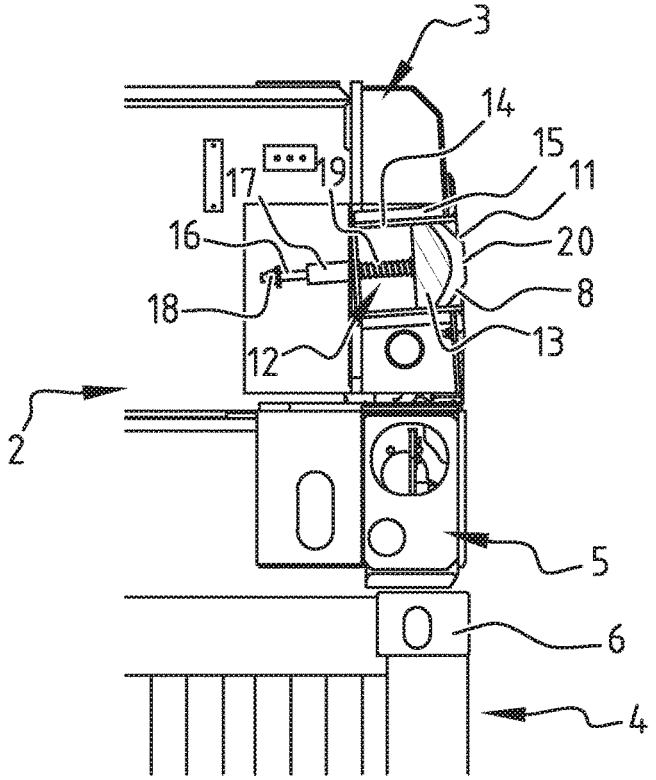
FIG. 4 is a view corresponding to FIG. 3 in which the detecting device is shown in partial longitudinal section.
Figure 5:
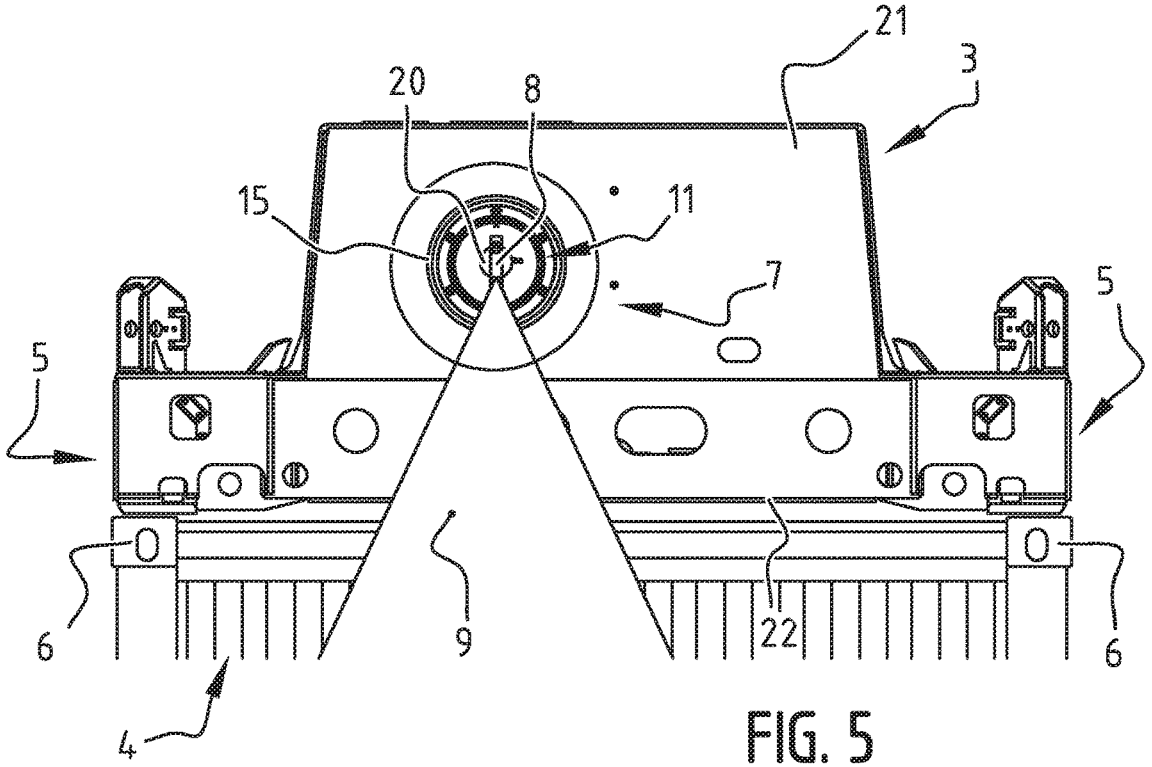
FIG. 5 is a front view of a part of the hoisting frame and the container of FIG. 1 in which the field of vision of the detecting device is represented schematically.
Figure 6:
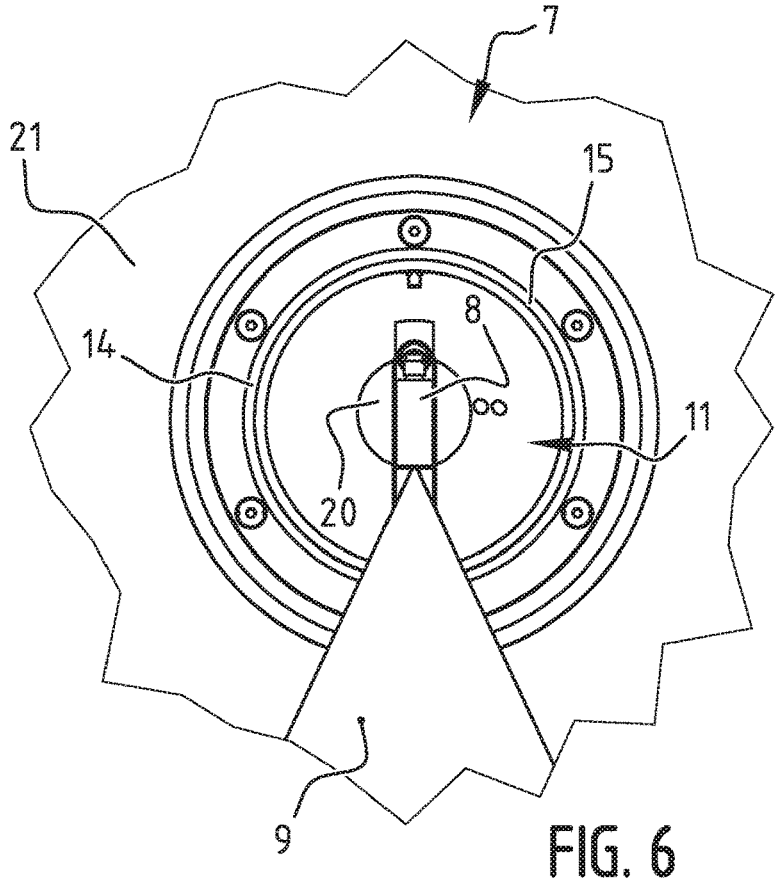
FIG. 6 is a detail view on enlarged scale of the detecting device in the hoisting frame of FIG. 5.

In the shown embodiment body 11 has a cylindrical base 13 which is slidable in a bearing bush 14 which is in turn received in an opening 15 in a side wall 21 of end beam 3 (FIG. 4). Because sufficient space is available in end beam 3 at the position of the connection to longitudinal beam 2, bearing bush 14 and body 11 with camera 8 therein can be given a relatively large and robust form. Protruding on the inner side from base 13 is a pin 16 which is received slidably in a central sleeve 17 and which has a thickened end 18. This dual guiding prevents the body 11 hanging askew and jamming A compression spring 19 is arranged round pin 16 between base 13 and sleeve 17. This compression spring 19 forms an embodiment of biasing means 12.

Body 11 is manufactured wholly or partially from a material which can properly withstand impact loads and which is sufficiently wear-resistant. The material from which body 11 is manufactured must moreover generate relatively little friction. In the shown embodiment body 11 is made from a plastic, although an embodiment in rubber could also be envisaged. Different types of metal can in addition be considered suitable, although it is important to select these such that body 11 cannot cause any damage to the surrounding area.

Camera 8 is arranged close to the narrow outer end 20 of body 11, but is recessed to some extent in order to be optimally protected from contact with obstacles. In the position of use camera 8 is situated here so far outside side wall 21 of end beam 3 that even a lower edge 22 of end beam 3 lies in its field of vision 9. Camera 8 can thus also be used in the control of movements of hoisting frame 1 when it is manoeuvred toward a load 4. In addition, the field of vision 9 will of course cover a significant part of the area surrounding hoisting frame 1 so that a good indication is obtained of the position of hoisting frame 1.

Figure 10:
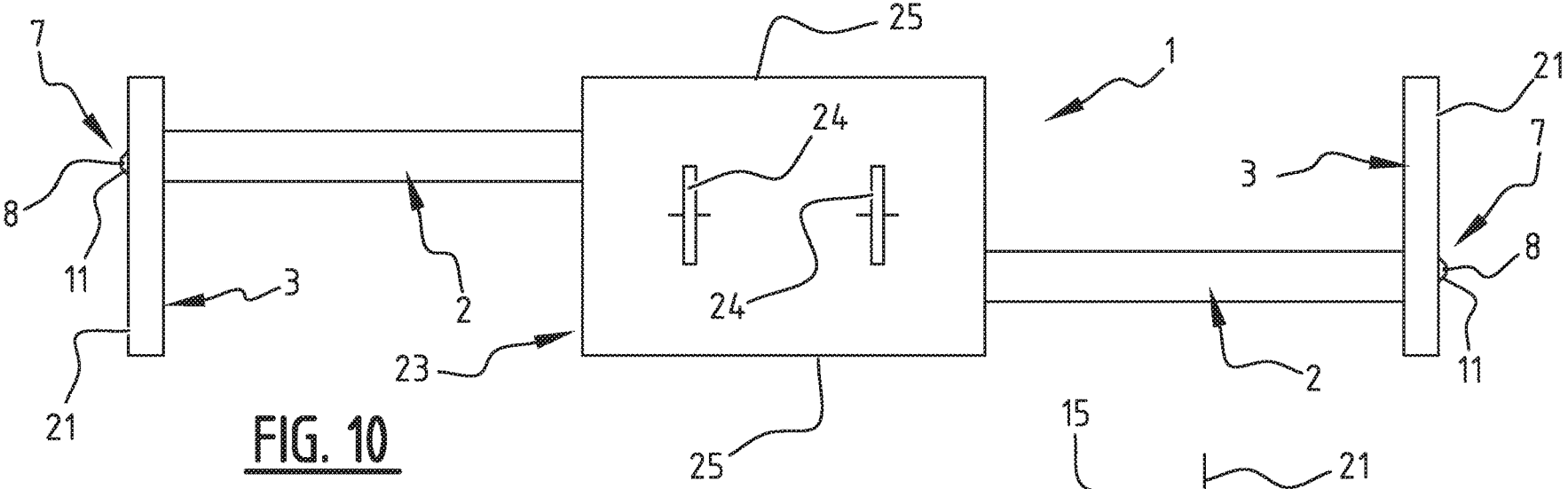
FIG. 10 is a schematic top view of a hoisting frame with a detecting device on either side.

For optimal control of the movements of hoisting frame 1 it is important that the most complete possible indication of its position is formed. In the shown embodiment each end beam 3 is provided for this purpose with a camera 8 protruding outside its side wall 21 (FIG. 10). Cameras could if desired also be arranged in or on side walls 25 of central body 23. Here too there is sufficient space for camera bodies in large and robust form.

Figure 11:
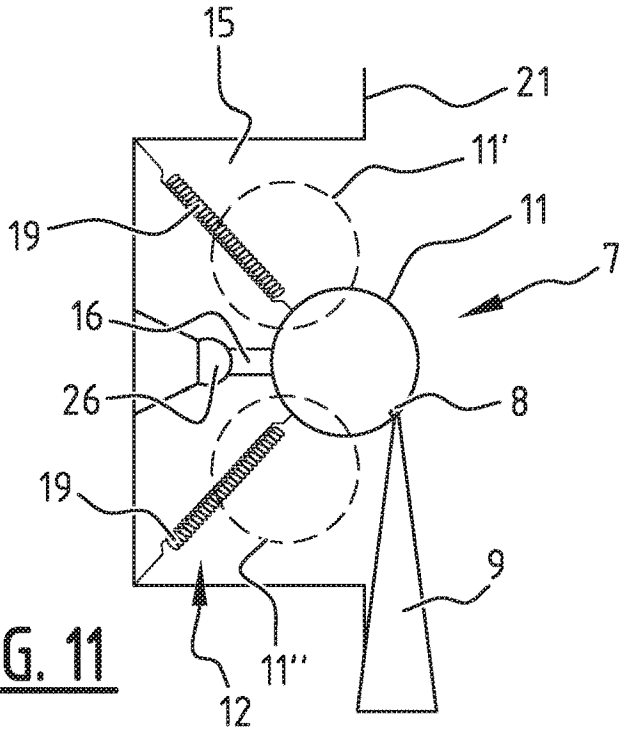
FIG. 11 is a schematic cross-section of an alternative embodiment of the detecting device.

Although in the shown embodiment body 11 with camera 8 is mounted slidably in hoisting frame 1, other types of movement can also be envisaged for moving camera 8 to a protected position within the periphery of hoisting frame 1. According to another embodiment of the invention, body 11 is mounted for pivoting to all sides in a relatively oversize opening 15 (FIG. 11). Body 11 is once again provided with a pin 16, which is mounted here in a ball hinge 26. Biasing means 12 here comprise a number of radially oriented springs 19 which centre the body 11 in opening 15 and which after each movement urge it back again to the central position in which camera 8 protrudes outside the periphery of hoisting frame 1.

As stated, the images from camera 8 are transmitted to a control system. The control system is largely automated and is configured to manoeuvre the hoisting frame autonomously to a position in the vicinity of a cell 27 in a vessel. Here the movement of hoisting frame 1 is stopped, after which an operator takes over control and, on the basis of the images from camera 8, lowers hoisting frame 1, with a possible container 4 attached thereto, into cell 27. It is advantageous here for different points on hoisting frame 1 and container 4 to be shown simultaneously by cameras 8 at different locations so that all obstacles in the surrounding area, for instance all edges of a cell 27, can be seen. Once container 4 and/or hoisting frame 1 are situated in cell 27, the remaining movement is once again carried out autonomously by the control system. A single operator can in this way monitor and, where necessary, control different cranes, this resulting in considerable savings compared to conventional cranes which are each controlled by an individual crane driver.

It is otherwise also possible to envisage that future control systems will be able to process the images digitally and also perform this critical step in the movement of hoisting frame 1 autonomously on the basis thereof.

Figure 9:
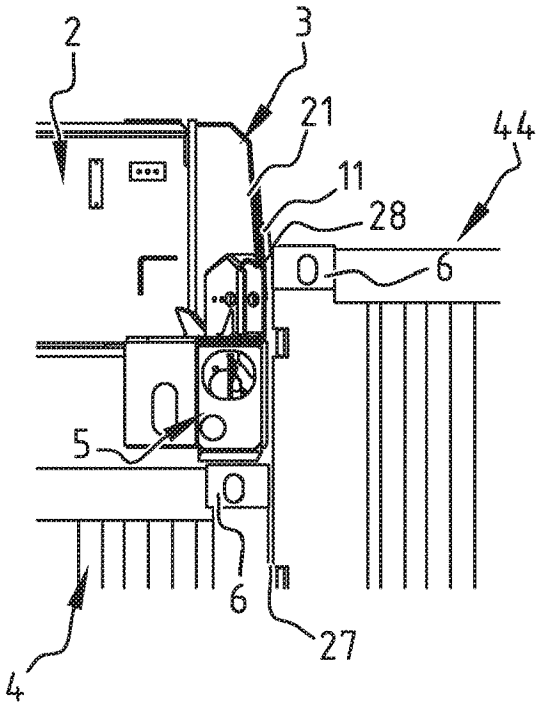
FIGS. 7, 8 and 9 are side views which show how the hoisting frame and the container are lowered into a cell, wherein the detecting device is urged to its protected position in the hoisting frame by contact with the surrounding area.
Figure 8:
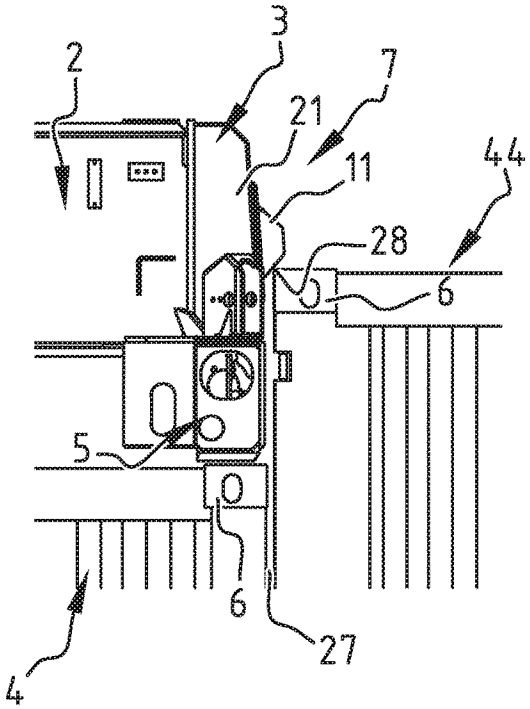
Figure 7:
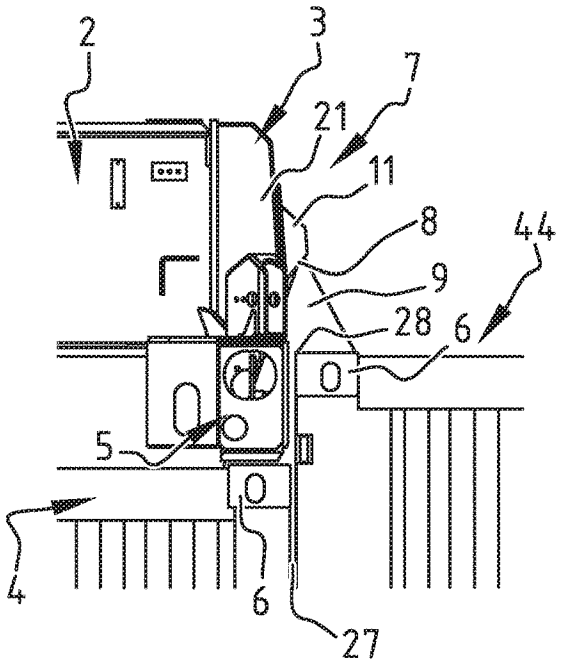

When hoisting frame 1 is lowered into cell 27 (FIG. 7), body 11 with camera 8 therein will at some point come into contact with the surrounding area, either a wall of cell 27 or an upper edge 28 of an adjacent container 44 (FIG. 8). Because body 11 moves with its sloping side along upper edge 28, it is pushed inward into bearing bush 14 counter to the pressure of compression spring 19 (FIG. 9). Camera 8 is thus protected from the surrounding area. When hoisting frame 1 is moved upward again out of cell 27, body 11 is once again urged outward by compression spring 19 to its position of use protruding outside the periphery of hoisting frame 1.

The invention thus makes it possible to precisely control a hoisting frame 1 on the basis of images made at the location of the hoisting frame itself without the risk of damage to the detecting device or blocking of the movement of the hoisting frame.

Although the invention has been elucidated above on the basis of a number of examples, it will be apparent that these can be varied in many ways. The scope of the invention is therefore defined solely by the following claims.

The invention claimed is:

1. A device for detecting a position of a hoisting frame, comprising:

at least one sensor which is connected movably to the hoisting frame and protrudes outside a periphery thereof in a position of use and which is movable between the position of use and a protected position lying within the periphery of the hoisting frame, wherein the hoisting frame is elongate and has two mutually opposite short sides, wherein each of the short sides has two mutually opposite ends with couplings arranged on or close to these ends, wherein each short side of the hoisting frame is formed by an end beam, and the hoisting frame further comprises at least one longitudinal beam, and wherein the at least one sensor is an image sensor and at least one image sensor is arranged on each of the short sides at a position lying between the ends thereof, wherein the at least one image sensor is arranged on the end beam substantially in line with the at least one longitudinal beam, and further comprising biasing means for biasing the at least one image sensor from the protected position to the position of use.

2. The device of claim 1, wherein the biasing means are mechanical biasing means.

3. The device of claim 1, wherein the hoisting frame has an upper side with means for suspension thereof from hoisting elements and an underside lying opposite the upper side, and the at least one image sensor has a field of vision oriented toward the underside of the hoisting frame.

4. The device of claim 3, wherein the field of vision of the at least one image sensor comprises a lower edge of a load attached to the hoisting frame.

5. The device of claim 1, wherein the at least one image sensor comprises a camera or a scanner.

6. A device for detecting a position of a hoisting frame, comprising:

at least one sensor which is connected movably to the hoisting frame and protrudes outside a periphery thereof in a position of use and which is movable between the position of use and a protected position lying within the periphery of the hoisting frame, wherein the hoisting frame is elongate and has two mutually opposite short sides, wherein each of the short sides has two mutually opposite ends with couplings arranged on or close to these ends, wherein each short side of the hoisting frame is formed by an end beam, and the hoisting frame further comprises at least one longitudinal beam, and wherein the at least one sensor is an image sensor and at least one image sensor is arranged on each of the short sides at a position lying between the ends thereof, wherein the at least one image sensor is arranged on the end beam substantially in line with the at least one longitudinal beam, and wherein the at least one image sensor is received in a body which is shaped such that under the influence of an external load it moves to the protected position.

7. The device of claim 6, wherein the body has a base part which faces toward the hoisting frame and is relatively wide and an outer end which faces away from the hoisting frame and is relatively narrow, and the at least one image sensor is arranged in or close to the narrow outer end.

8. The device of claim 6, wherein the body is mounted slidably in the hoisting frame.

9. The device of claim 6, wherein the body is mounted pivotally in the hoisting frame.

10. The device of claim 6, wherein the body is manufactured from a material able to withstand impact loads.

11. The device of claim 6, wherein the at least one image sensor comprises a camera or a scanner.

12. A device for detecting a position of a hoisting frame, comprising: at least one sensor which is connected movably to the hoisting frame and protrudes outside a periphery thereof in a position of use and which is movable between the position of use and a protected position lying within the periphery of the hoisting frame, wherein the hoisting frame is elongate and has two mutually opposite short sides, wherein each of the short sides has two mutually opposite ends with couplings arranged on or close to these ends, wherein the at least one sensor is an image sensor and at least one image sensor is arranged on each of the short sides at a position lying between the ends thereof, and wherein the hoisting frame has an upper side with means for suspension thereof from hoisting elements and an underside lying opposite the upper side, and the at least one image sensor has a field of vision oriented toward the underside of the hoisting frame; and further comprising biasing means for biasing the at least one image sensor from the protected position to the position of use.

13. The device of claim 12, further comprising means for connecting the at least one image sensor to a control system for a crane from which the hoisting frame is suspended.

14. The device of claim 12, wherein the field of vision of the at least one image sensor comprises a lower edge of a load attached to the hoisting frame.

15. The device of claim 12, wherein the at least one image sensor comprises a camera or a scanner.

16. A device for detecting a position of a hoisting frame, comprising: at least one sensor which is connected movably to the hoisting frame and protrudes outside a periphery thereof in a position of use and which is movable between the position of use and a protected position lying within the periphery of the hoisting frame, wherein the hoisting frame is elongate and has two mutually opposite short sides, wherein each of the short sides has two mutually opposite ends with couplings arranged on or close to these ends, and wherein the at least one sensor is an image sensor and at least one image sensor is arranged on each of the short sides at a position lying between the ends thereof, and further comprising means for connecting the at least one image sensor to a control system for a crane from which the hoisting frame is suspended; and further comprising biasing means for biasing the at least one image sensor from the protected position to the position of use.

17. The device of claim 16, further comprising means for biasing the at least one image sensor from the protected position to the position of use.

18. The device of claim 16, wherein the at least one image sensor is received in a body which is shaped such that under the influence of an external load it moves to the protected position.

19. The device of claim 16, wherein the at least one image sensor comprises a camera or a scanner.

20. The device of claim 16, wherein each short side of the hoisting frame is formed by an end beam, and the hoisting frame further comprises at least one longitudinal beam, wherein the at least one image sensor is arranged on the end beam substantially in line with the at least one longitudinal beam.

* * * * *